US011839303B2

(12) United States Patent
Sun et al.

(10) Patent No.: US 11,839,303 B2
(45) Date of Patent: Dec. 12, 2023

(54) MOVABLE CHAIR DEVICE AND CHAIR ASSEMBLY

(71) Applicant: HAINING HELI MACHINERY & TECHNOLOGY CO., LTD., Jiaxing (CN)

(72) Inventors: Xiqi Sun, Jiaxing (CN); Xiaozhao Zhang, Jiaxing (CN); Qiu Xu, Jiaxing (CN)

(73) Assignee: HAINING HELI MACHINERY & TECHNOLOGY CO., LTD., Jiaxing (CN)

( * ) Notice: Subject to any disclaimer, the term of this patent is extended or adjusted under 35 U.S.C. 154(b) by 24 days.

(21) Appl. No.: 17/734,064

(22) Filed: May 1, 2022

(65) Prior Publication Data

US 2023/0068014 A1 Mar. 2, 2023

(30) Foreign Application Priority Data

Aug. 26, 2021 (CN) ..... 202122040114.7

(51) Int. Cl.
*A47C 1/035* (2006.01)
*A47C 1/024* (2006.01)

(52) U.S. Cl.
CPC ..... *A47C 1/024* (2013.01); *A47C 1/035* (2013.01)

(58) Field of Classification Search
CPC ..... A47C 1/035; A47C 1/0355
See application file for complete search history.

(56) References Cited

U.S. PATENT DOCUMENTS

| | | | | | |
|---|---|---|---|---|---|
| 4,365,836 | A * | 12/1982 | Jackson | A47C 1/03211 | 297/85 M |
| 4,492,407 | A * | 1/1985 | Broadhead | A47C 1/035 | 297/84 X |
| 2006/0061148 | A1* | 3/2006 | Pollard | A47C 1/024 | 297/85 M |
| 2013/0200659 | A1* | 8/2013 | Hoffman | A47C 1/035 | 297/84 |
| 2018/0352960 | A1* | 12/2018 | Carrera | A47C 7/506 | |

* cited by examiner

*Primary Examiner* — Rodney B White

(57) ABSTRACT

A movable chair device and a chair assembly are provided. The movable chair device includes a chair mechanism and a transmission mechanism. The transmission mechanism includes a primary transmission component and an intermediate transmission component. The primary transmission component includes: a fixing member, a first swing arm, a second swing arm and a first linkage member. The first linkage member is enclosed with the first swing arm, the second swing arm and the fixing member to form a closed-loop connecting rod mechanism. The intermediate transmission component includes a first transmission arm, a second transmission arm and a third transmission arm.

16 Claims, 7 Drawing Sheets

MOVABLE CHAIR DEVICE AND CHAIR ASSEMBLY

CROSS-REFERENCE TO RELATED APPLICATIONS

This application claims all benefits accruing under 35 U.S.C. § 119 from China Patent Application No. 202122040114.7, filed on Aug. 26, 2021, titled "MOVABLE CHAIR DEVICE AND CHAIR ASSEMBLY" in the China National Intellectual Property Administration, the content of which is hereby incorporated by reference.

TECHNICAL FIELD

The present disclosure generally relates to furniture, and in particular, to a movable chair device and a chair assembly.

BACKGROUND

A movable chair device can adjust sitting and lying postures of a user. The movable chair device includes a chair mechanism configured to support the user. The movable chair device can be adjusted as needed and drive the chair mechanism to move, thus forming three different states of use which can include sitting, leisure and lying.

The movable chair device has some problems. A height of the chair mechanism may change significantly when the state of use of the movable chair device switches from sitting to leisure and further to lying, creating an up and down feeling of instability to the user. In order to eliminate the up and down feeling, the chair mechanism can further include a transmission mechanism. The transmission mechanism can extend or contract to drive the chair mechanism to move relative to the ground according to a predetermined trajectory.

However, a conventional transmission mechanism still has other disadvantages including lacking smoothness and reliability of movement. In addition, the transmission mechanism has a poor load capacity because of a low load-bearing limit. The transmission mechanism is also prone to non-action or movement suspension if the user is above a certain weight, which would accelerate wear and tear of the movable chair device.

SUMMARY

Thus, it is desired to provide a movable chair device. The movable chair device includes a chair mechanism and a transmission mechanism. The transmission mechanism includes a primary transmission component and an intermediate transmission component. The primary transmission component includes: a fixing member configured for fixing to a support; a first swing arm pivotally connected to the fixing member; a second swing arm pivotally connected to the fixing member, and a first linkage member pivotally connected to the first swing arm and the second swing arm respectively. The first linkage member is enclosed with the first swing arm, the second swing arm and the fixing member to form a closed-loop connecting rod mechanism. The intermediate transmission component includes: a first transmission arm, a first end of which is pivotally connected to the first swing arm and a second end of which is pivotally connected to the chair mechanism; a second transmission arm, a first end of which is pivotally connected to the second swing arm and a second end of which is pivotally connected to the chair mechanism; and a third transmission arm, a first end of which is pivotally connected to the second transmission arm, and a second end of which is movably connected to the first transmission arm and/or the first swing arm.

In some embodiments, a first pin joint and a second pin joint are disposed between two ends of the first swing arm, the first pin joint is configured for being pivotally connected to the first transmission arm, and the second pin joint is configured for being pivotally connected to the third transmission arm.

In some embodiments, the first swing arm includes a swing portion and a transmission portion protruding from a side of the swing portion, a first end of the swing portion is pivotally connected to the first linkage member, a second end of the swing portion is pivotally connected to the fixing member, and an angle is defined between the transmission portion and the swing portion; and the first pin joint is located at the swing portion, and the second pin joint is located at a side away from the swing portion of the transmission portion.

In some embodiments, a pivot point between the second transmission arm and the third transmission arm is located between a pivot point of the second transmission arm and the second swing arm and a pivot point of the second transmission arm and the chair mechanism.

In some embodiments, a pivot point between the second swing arm and the second transmission arm is located between a pivot point of the second swing arm and the first linkage member and a pivot point of the second swing arm and the fixing member.

In some embodiments, the chair mechanism includes a chair component and a secondary transmission component, the chair component is provided with a chair supporting area for supporting body, and the secondary transmission component is connected to a side away from the chair supporting area of the chair component.

In some embodiments, the secondary transmission component includes: a third swing arm, an end of which is pivotally connected to a side away from the chair supporting area of the chair component; a fourth swing arm, an end of which is pivotally connected to a side away from the chair supporting area of the chair component; and a second linkage member. A first pivot point, a second pivot point, a third pivot point, and a fourth pivot point are disposed on the second linkage member sequentially along a length direction of the second linkage member. The first pivot point is pivotally connected to the third swing arm, the second pivot point is pivotally connected to the first transmission arm, the third pivot point is pivotally connected to the fourth swing arm, and the fourth pivot is pivotally connected to the second transmission arm.

In some embodiments, a stopping convex block is fixedly arranged on the chair component for stopping the third swing arm and/or the fourth swing arm, and limiting a range of a motion of the secondary transmission component relative to the chair component.

In some embodiments, the fixing member is provided with a first limiting portion, a second limiting portion, and a swing center, which is defined as a pivot point between the fixing member and the second swing arm; a swing angle is defined by a line between the first limiting portion and the swing center and a line between the second limiting portion and the swing center; and the first limiting portion and the second limiting portion are configured for abutting against the second swing arm, respectively, resulting in that the second swing arm is able to swing relative to the fixing member within a range of the swing angle.

The present disclosure further provides a chair assembly including the support and the movable chair device as described above, the support is capable of being placed on the ground and is fixedly connected to the fixing member; the movable chair device includes the chair mechanism and the transmission mechanism. The transmission mechanism includes the primary transmission component and the intermediate transmission component; the primary transmission component includes: the fixing member configured for fixing to the support; the first swing arm, which is pivotally connected to the fixing member; the second swing arm, which is pivotally connected to the fixing member, and the first linkage member, which is pivotally connected to the first swing arm and the second swing arm respectively. The first linkage member is enclosed with the first swing arm, the second swing arm and the fixing member to form the closed-loop connecting rod mechanism; the intermediate transmission component includes: the first transmission arm, the first end of which is pivotally connected to the first swing arm and the second end of which is pivotally connected to the chair mechanism; the second transmission arm, the first end of which is pivotally connected to the second swing arm and the second end of which is pivotally connected to the chair mechanism; and the third transmission arm, the first end of which is pivotally connected to the second transmission arm, and the second end of which is movably connected to the first transmission arm and/or the first swing arm.

In some embodiments, the first pin joint and the second pin joint are disposed between two ends of the first swing arm, the first pin joint is configured for being pivotally connected to the first transmission arm, and the second pin joint is configured for being pivotally connected to the third transmission arm.

In some embodiments, the first swing arm includes the swing portion and the transmission portion protruding from the side of the swing portion, the first end of the swing portion is pivotally connected to the first linkage member, the second end of the swing portion is pivotally connected to the fixing member, and the angle is defined between the transmission portion and the swing portion; the first pin joint is located at the swing portion, and the second pin joint is located at the side away from the swing portion of the transmission portion.

In some embodiments, the pivot point between the second transmission arm and the third transmission arm is located between the pivot point of the second transmission arm and the second swing arm and the pivot point of the second transmission arm and the chair mechanism.

In some embodiments, the pivot point between the second swing arm and the second transmission arm is located between the pivot point of the second swing arm and the first linkage member and the pivot point of the second swing arm and the fixing member.

In some embodiments, the chair mechanism includes the chair component and the secondary transmission component, the chair component is provided with the chair supporting area for supporting body, and the secondary transmission component is connected to the side away from the chair supporting area of the chair component.

In some embodiments, the secondary transmission component includes: the third swing arm, the end of which is pivotally connected to the side away from the chair supporting area of the chair component; the fourth swing arm, the end of which is pivotally connected to the side away from the chair supporting area of the chair component; and the second linkage member. The first pivot point, the second pivot point, the third pivot point, and the fourth pivot point are disposed on the second linkage member sequentially along a length direction of the second linkage member. The first pivot point is pivotally connected to the third swing arm, the second pivot point is pivotally connected to the first transmission arm, the third pivot point is pivotally connected to the fourth swing arm, and the fourth pivot is pivotally connected to the second transmission arm.

In some embodiments, the stopping convex block is fixedly arranged on the chair component for stopping the third swing arm and/or the fourth swing arm, and limiting the range of the motion of the secondary transmission component relative to the chair component.

In some embodiments, the fixing member is provided with the first limiting portion, the second limiting portion, and the swing center, which is defined as the pivot point between the fixing member and the second swing arm; the swing angle is defined by the line between the first limiting portion and the swing center and the line between the second limiting portion and the swing center; and the first limiting portion and the second limiting portion are configured for abutting against the second swing arm, respectively, resulting in that the second swing arm is able to swing relative to the fixing member within the range of the swing angle.

Figure 1:
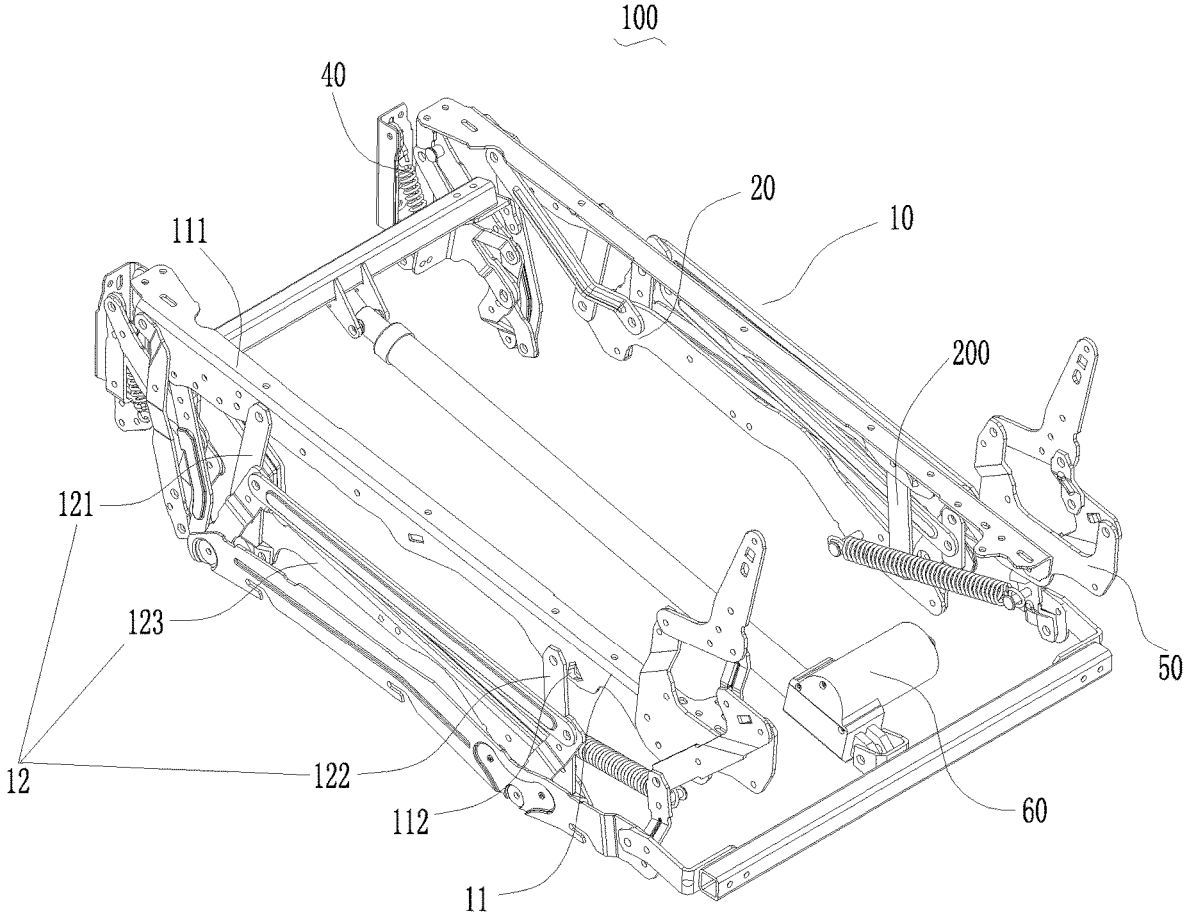
FIG. 1 is a structural schematic view of a movable chair device in a sitting state in an embodiment of the present disclosure.

In the figures, 100 represents a movable chair device; 200 represents a chair assembly; 10 represents a chair mechanism; 20 represents a transmission mechanism; 30 represents a support; 40 represents a footrest mechanism; 50 represents a back mechanism; 60 represents a driving mechanism; 11 represents a chair component; 12 represents a secondary transmission component; 111 represents a chair supporting area; 112 represents a stopping convex block; 121 represents a third swing arm; 122 represents a fourth swing arm; 123 represents a second linkage member; 21 represents a primary transmission component; 22 represents an intermediate transmission component; 211 represents a fixing member; 2111 represents a first limiting portion; 2112 represents a second limiting portion; 2113 represents a swing center; 212 represents a first swing arm; 2121 represents a first pin joint; 2122 represents a second pin joint; 2123 represents a swing portion; 2124 represents a transmission portion; 213 represents a second swing arm; 214 represents a first linkage member; 221 represents a first transmission arm; 222 represents a second transmission arm; 223 represents a third transmission arm; A1 represents a pivot point between the second transmission arm and the third transmission arm; A2 represents a pivot point of the second transmission arm and the second swing arm; A3 represents a pivot point of the second transmission arm and the chair mechanism; B2 represents a pivot point of the second swing arm and the first linkage member; B3 represents a pivot point of the second swing arm and the fixing member.

DETAILED DESCRIPTION OF THE EMBODIMENT

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without departing from the inventive scope are the scope of the present disclosure.

Unless otherwise defined, all technical and scientific terms used herein have the same meaning as a skilled person in the art would understand. The terminology used in the description of the present disclosure is for the purpose of describing particular embodiments and is not intended to limit the disclosure. The term "or/and" as used herein includes any and all combinations of one or more of the associated listed items.

The present disclosure provides a movable chair device 100 with a function of adjusting sitting and lying postures of a user. The movable chair device 100 includes a chair mechanism 10 and a transmission mechanism 20. The chair mechanism 10 can include a chair component 11 and a secondary transmission component 12, and the transmission mechanism 20 includes a primary transmission component 21 and an intermediate transmission component 22.

In this way, the movable chair device 100 has better orderliness in operation. The primary transmission component 21 is configured to transfer power to the chair component 11 when the state of use of the movable chair device 100 switches from leisure to lying, and the secondary transmission component 12 is configured to transfer power to the chair component 11 when the state of use of the movable chair device 100 switches from sitting to leisure. Thus a movement of the movable chair device 100 is divided into two different stages, in which the state of use of the movable chair device 100 switching from sitting to lying, and from lying to sitting. The primary transmission component 21 is configured for a power transmission of a first stage, and the secondary transmission component 12 is configured for a power transmission of a second stage, so that the movable chair device 100 would not run unstably resulting from a synchronous motion of the primary transmission component 21 and the secondary transmission component 12.

Specifically, the chair component 11 configured for supporting the user is provided with a chair supporting area 111 for supporting body. The secondary transmission component 12 is movably connected to a side away from the chair supporting area 111 of the chair component 11, and movably connected to the primary transmission component 21 by the intermediate transmission component 22. The primary transmission component 21 includes a fixing member 211, which is configured for fixing to a support 30 outside the movable chair device 100. Thus, when the movable chair device 100 is assembled in the chair assembly 200, the movable chair device 100 can be fixedly mounted on the support 30 of the chair assembly 200 by the fixing member 211.

Alternatively, the chair supporting area 111 is set at a rearward tilt relative to the horizontal ground, and a height of the chair supporting area 111 near a front end of the chair component 11 is higher than a height of the chair supporting area 111 near a rear end of the chair component 11. A tilt trend is independent of a posture of the movable chair device 100, i.e., the chair supporting area 111 is kept at a rearward tilt relative to the horizontal ground when the movable chair device 100 is in a sitting state, a leisure state or a lying state.

In some embodiments, the movable chair device 100 can further include a driving mechanism 60 and a footrest mechanism 40. The footrest mechanism 40 can be pivotally connected to the front end of the chair component 11 and connected to the secondary transmission component. The driving mechanism 60 can be mounted to the fixing member 211, and a power output end of the driving mechanism 60 is connected to the footrest mechanism 40. When the driving mechanism 60 is in operation to generate driving force, the power output end of the driving mechanism 60 can drive the footrest mechanism 40 to rotate relative to the chair component 11, and control a movement of a foot supporting component of the footrest mechanism 40 close to or away from the front end of the chair component 11.

Since the footrest mechanism 40 is connected to the secondary transmission component 12, when the driving mechanism 60 generates power to drive the movement of the footrest mechanism 40, a part of the power would be transferred to the secondary transmission component 12, then be transferred to the primary transmission component 21 by the intermediate transmission component 22, and finally drive the chair component 11 to move relative to the fixing member 211 to achieve a purpose of switching states of use of the movable chair device 100.

In the present embodiment, the driving mechanism 60 can include a screw motor, a motor body of the screw motor is mounted on the fixing member 211, and a screw of the screw motor is inserted into the motor body. The screw can move up/down along axial direction thereof relative to the motor body, and an end of the screw extending from the motor body is connected to and driven by the footrest mechanism 40. When a length of the screw extending from the motor body increases, the footrest mechanism 40 can move from a contracting and closing state to an extending state.

Thus, a state adjustment of the movable chair device 100 in the present embodiment requires no external force from the user, and driving power can be generated by the driving mechanism 60 alone. It can be understood that in other embodiments, it is also possible to adjust the state of the movable chair device 100 by human power of the user without the driving mechanism 60.

Furthermore, in the present embodiments, the movable chair device 100 can further include a back mechanism 50 mounted on the rear end of the chair component 11, which is configured to provide supporting for the user's lumbar and back. The back mechanism 50 is able to change an angle between the back mechanism 50 and the chair supporting area 111 according to the state of the movable chair device 100.

It can be understood that the back mechanism 50 is not a necessary mechanism for the movable chair device 100. In some other embodiments, the back mechanism 50 may not be provided. Alternatively, the back mechanism 50 may be a structure independent of the movable chair device 100, without further elaboration.

It is further noted that in the present disclosure, the front end of the chair component 11 is defined by an end located on the front side of the user of the chair component 11 when the user is sitting on the chair supporting area 111; the rear end of the chair component 11 is defined by an end located on the rear side of the user of the chair component 11 when the user is sitting on the chair supporting area 111. The foot supporting component is defined by a part located on the footrest mechanism 40 and away from the chair component 11. The foot supporting component is configured for supporting the user's lower legs and feet. The support 30 of the chair assembly 200 is able to directly contact the ground to bear weight of the movable chair device 100 and a human body.

Figure 2:
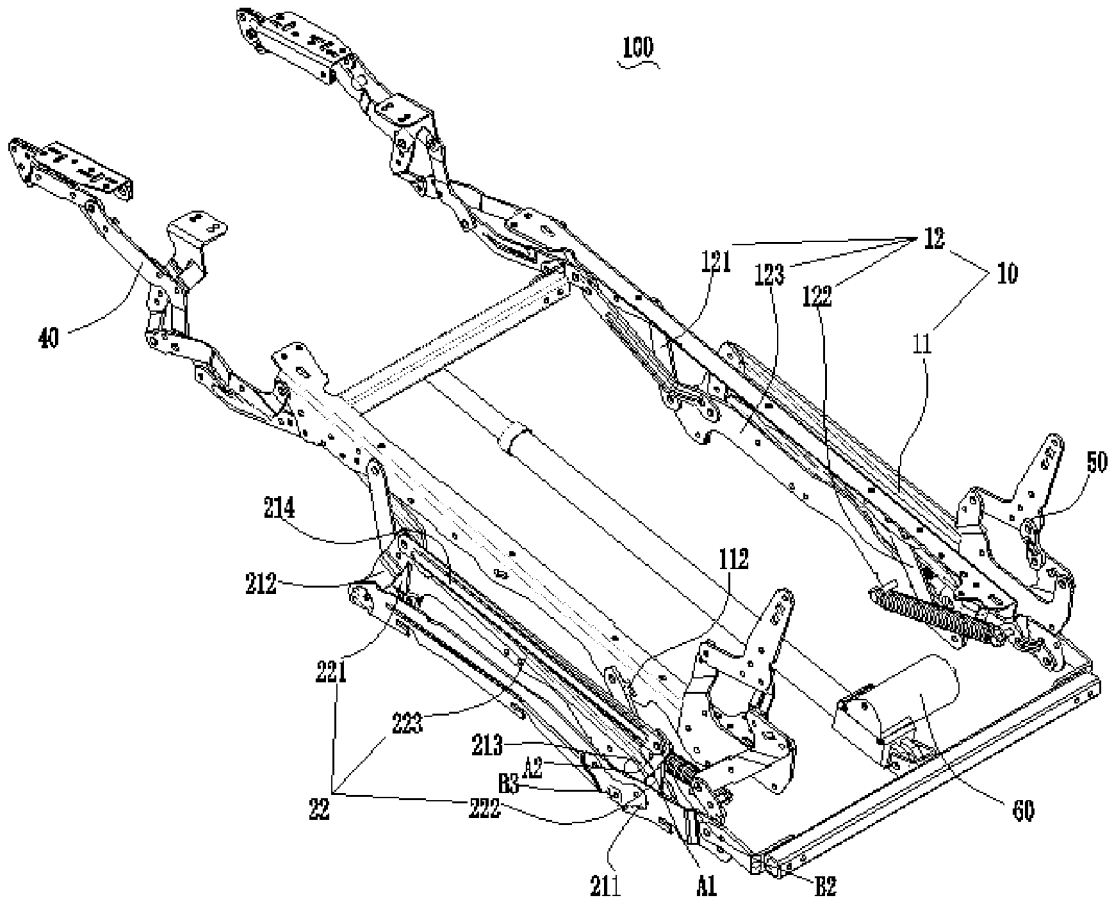
FIG. 2 is a structural schematic view of the movable chair device in a leisure state of FIG. 1.
Figure 3:
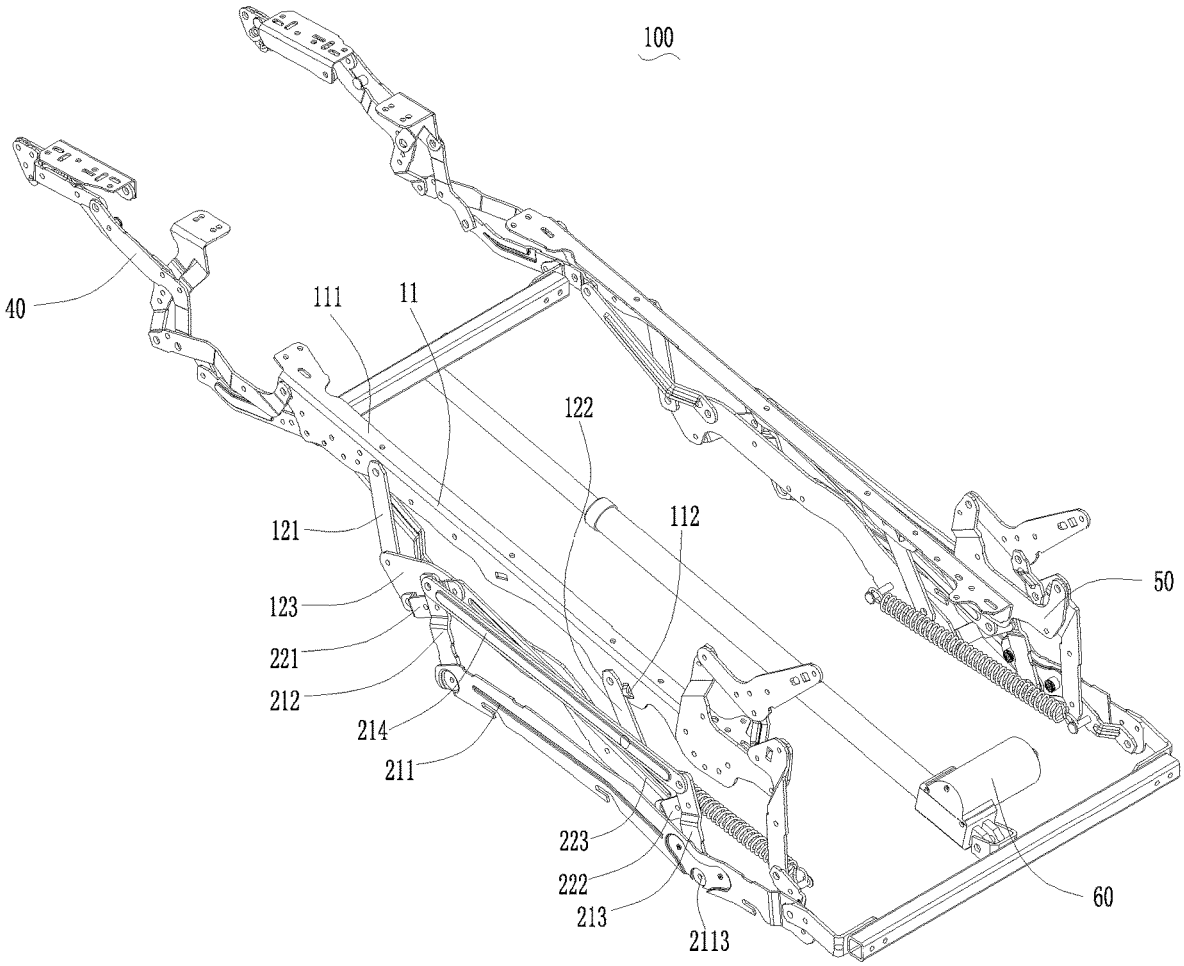
FIG. 3 is a structural schematic view of the movable chair device in a lying state of FIG. 1.
Figure 4:
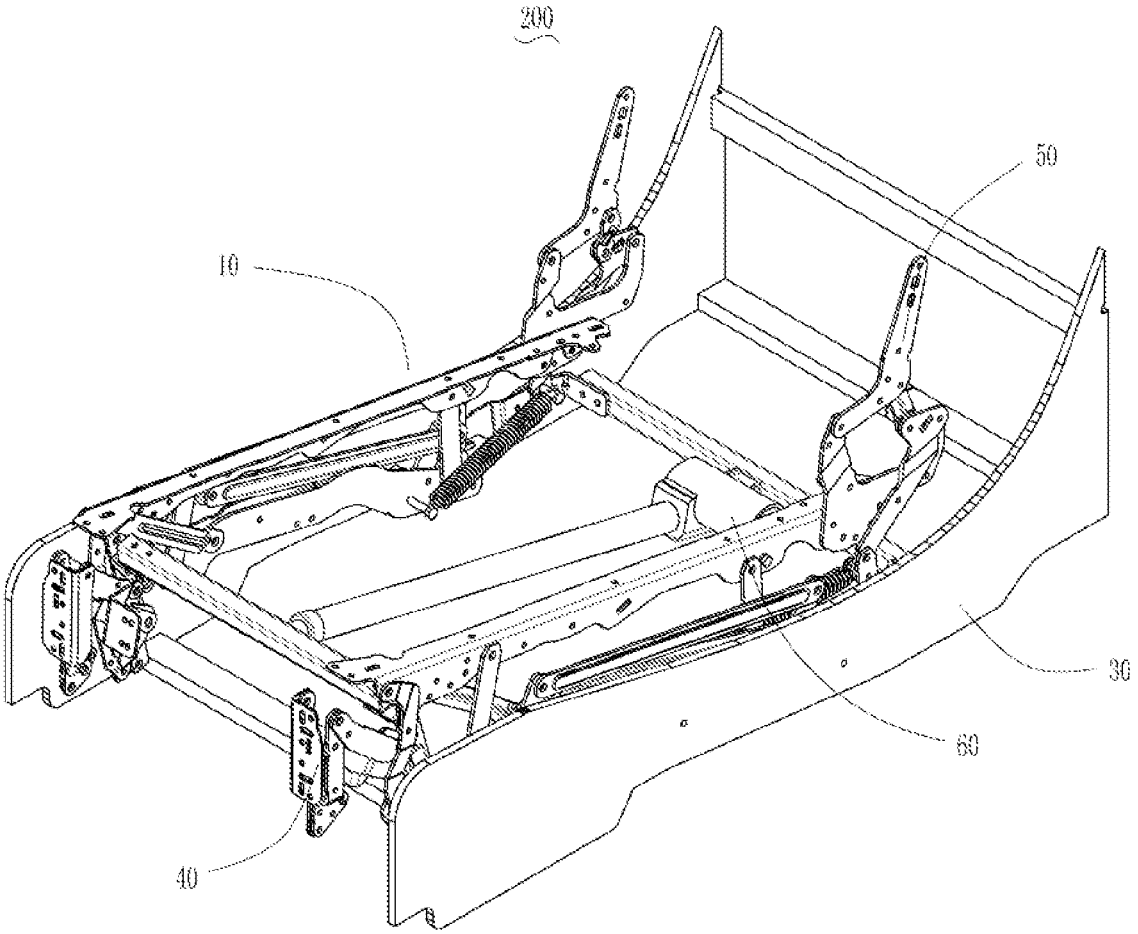
FIG. 4 is a structural schematic view of a chair in a sitting state in an embodiment of the present disclosure.

Referring to FIG. 1 to FIG. 4, FIG. 1 is a structural schematic view of a movable chair device 100 in a sitting state in an embodiment of the present disclosure. FIG. 2 is a structural schematic view of the movable chair device 100 in a leisure state of FIG. 1. FIG. 3 is a structural schematic view of the movable chair device 100 in a lying state of FIG. 1. FIG. 4 is a structural schematic view of a chair in a sitting state in an embodiment of the present disclosure.

Specifically, the movable chair device 100 of the present disclosure is provided with three different states of use which can include sitting, leisure and lying, so that the user can adjust the state on the chair supporting area 111 according to requirements. When the movable chair device 100 is in a sitting state, the footrest mechanism 40 can remain contracting and closing at the front side of the chair component 11 towards the ground. When the movable chair device 100 is switched to a leisure state, an angle between the footrest mechanism 40 and the chair component 11 can increases, and the footrest mechanism 40 can extend towards the outside of the front side of the chair component 11 to support the user's legs and feet, resulting in that the user is able to extend his legs. When the movable chair device 100 is switched further to a lying state, the footrest mechanism 40 continues to maintain an extending state in the leisure state and support the user's legs. Meanwhile, the angle between the back mechanism 50 and the chair component 11 can increase, and the back mechanism 50 can move towards outside of the rear end of the chair component 11 to support the user's back and lumbar.

A conventional movable chair device has a problem, in which a height of a conventional chair mechanism can change significantly when a state of use of the conventional movable chair device is switched from sitting to leisure and further to lying, creating an up and down feeling of instability to the user. In order to eliminate the up and down feeling, the conventional chair mechanism can further include a conventional transmission mechanism. The conventional transmission mechanism can extend or contract to drive the conventional chair mechanism to move relative to the ground according to a predetermined trajectory.

However, the conventional transmission mechanism still has problems of lacking smoothness and reliability of movement. In addition, the conventional transmission mechanism has a poor load capacity because of a low load-bearing limit. The conventional transmission mechanism is also prone to non-action or movement suspension if the user is above a certain weight, which would accelerate wear and tear of the conventional movable chair device.

Thus, in the movable chair device 100 provided in the present disclosure, the primary transmission component 21 can include a first swing arm 212, a second swing arm 213 and a first linkage member 214. The secondary transmission component 12 can include a third swing arm 121, a fourth swing arm 122 and a second linkage member 123. The intermediate transmission component 22 can include a first transmission arm 221, a second transmission arm 222 and a third transmission arm 223.

The movable chair device 100 has many advantages, such as better smoothness, better reliability of load-bearing, and higher load-bearing limit in motion. Thus the movable chair device 100 can alleviate the wear and tear and jamming in operation, improve response sensitivity to a power input of the driving mechanism 60, and is less prone to non-action or movement suspension, thus providing a much better user experience.

Figure 5:
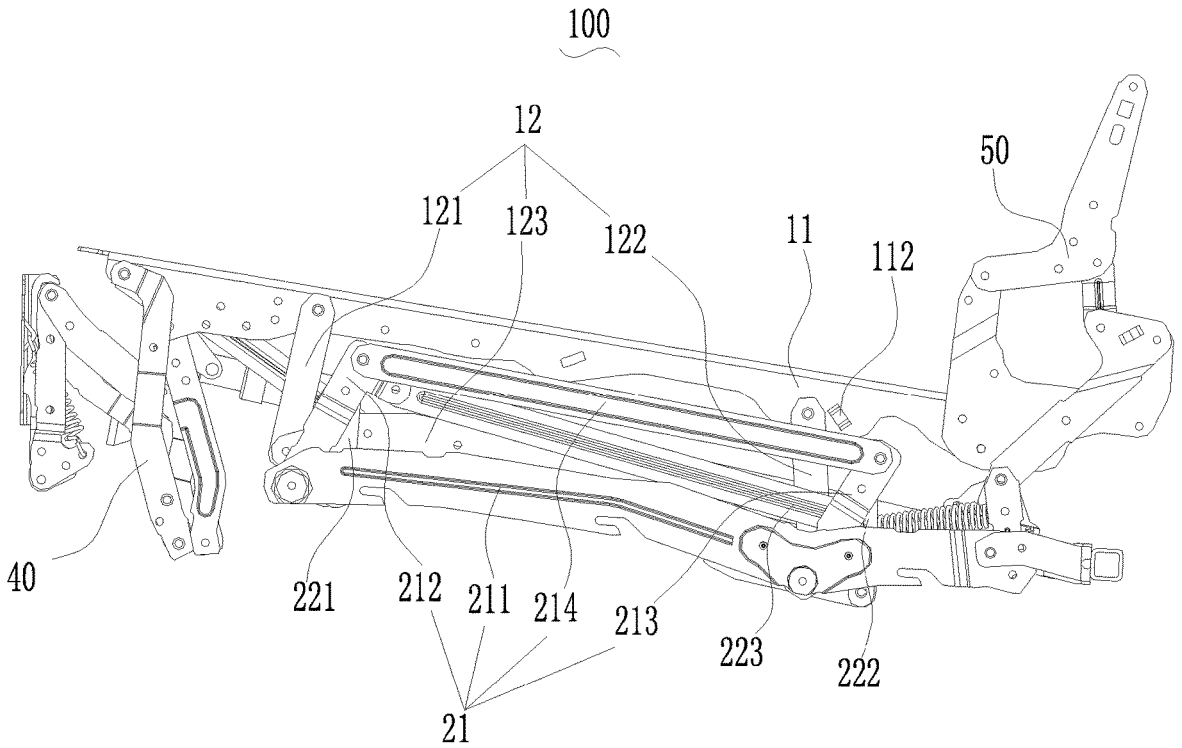
FIG. 5 is a side view of the movable chair device in a sitting state of FIG. 1.
Figure 6:
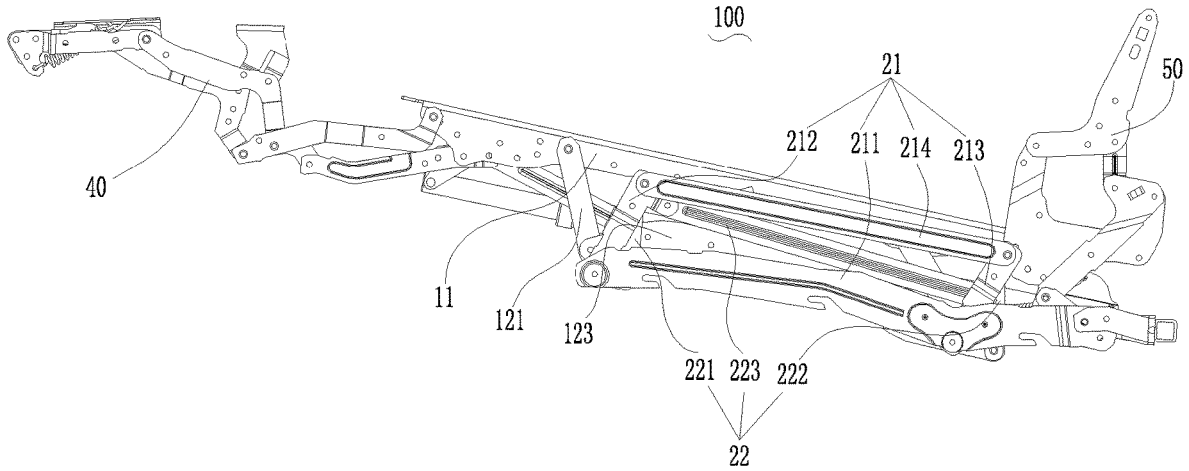
FIG. 6 is a side view of the movable chair device in a leisure state of FIG. 1.
Figure 7:
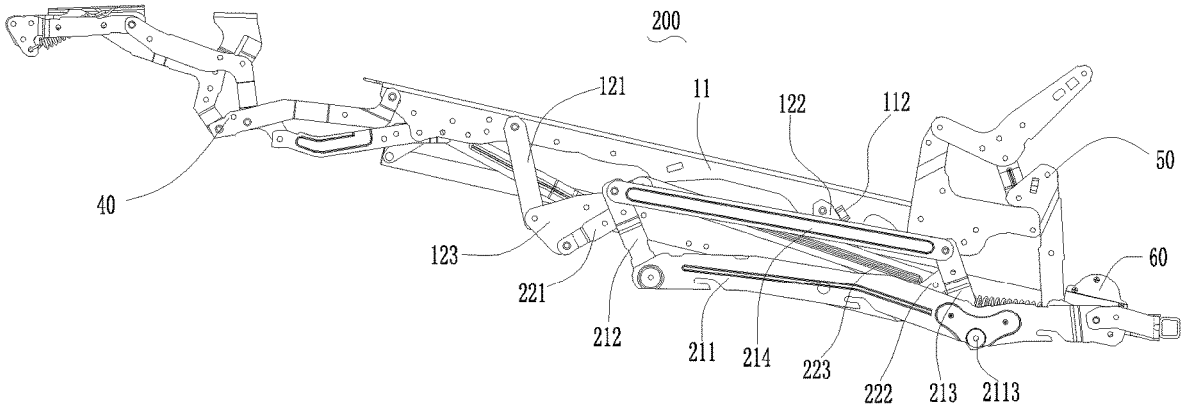
FIG. 7 is a side view of the movable chair device in a lying state of FIG. 1.

Referring to FIG. 5 to FIG. 7, FIG. 5 is a side view of the movable chair device 100 in a sitting state of FIG. 1. FIG. 6 is a side view of the movable chair device 100 in a leisure state of FIG. 1. FIG. 7 is a side view of the movable chair device 100 in a lying state of FIG. 1.

An end of the first swing arm 212 and an end of the second swing arm 213 can be pivotally connected to the fixing member 211. The first linkage member 214 can be pivotally connected between an end away from the fixing member 211 of the first swing arm 212 and an end away from the fixing member 211 of the second swing arm 213. The first linkage member 214 can be enclosed with the first swing arm 212, the second swing arm 213 and the fixing member 211 to form a closed-loop connecting rod mechanism, which is a four-link mechanism and has a defined trajectory of movement.

Furthermore, an end of the third swing arm 121 and an end of the fourth swing arm 122 can be pivotally connected to a side away from the chair supporting area 111 of the chair component 11. A first pivot point, a second pivot point, a third pivot point, and a fourth pivot point can be disposed on the second linkage member 123 sequentially along a length direction of the second linkage member 123. The first pivot point can be pivotally connected to an end away from the chair component 11 of the third swing arm 121, the second pivot point can be pivotally connected to the first transmission arm 221, the third pivot point can be pivotally connected to an end away from the chair component 11 of the fourth swing arm 122, and the fourth pivot can be pivotally connected to the second transmission arm 222. The second linkage member 123 can be enclosed with the third swing arm 121, the chair component 11 and the fourth swing arm 122 to form a closed-loop connecting rod mechanism, which is a four-link mechanism and has a defined trajectory of movement.

Furthermore, as described above, a first end of the first transmission arm 221 and a first end of the second transmission arm 222 can be pivotally connected to the second linkage member 123, a second end of the first transmission arm 221 can be pivotally connected to the first swing arm 212, and a second end of the second transmission arm 222 can be pivotally connected to the second linkage member 123. A first end of the third transmission arm 223 can be pivotally connected to the second transmission arm 222, and a second end of the third transmission arm 223 can be movably connected to the first transmission arm 221 and/or the first swing arm 212.

Specifically, in the present disclosure, the first swing arm 212 can include a swing portion 2123 and a transmission portion 2124 protruding from a side of the swing portion 2123, a first end of the swing portion 2123 can be pivotally connected to the first linkage member 214, a second end of the swing portion 2123 can be pivotally connected to the fixing member 211, and an angle can be defined between the transmission portion 2124 and the swing portion 2123. A first pin joint 2121 and a second pin joint 2122 can be disposed on the first swing arm 212. The first pin joint 2121 can be located at the swing portion 2123 and between a pivot point of the swing portion 2123 and the first linkage member 214 and a pivot point of the swing portion 2123 and the fixing member 211, and the second pin joint 2122 can be located at a side away from the swing portion 2123 of the transmission portion 2124.

Alternatively, the swing portion 2123 and the transmission portion 2124 can be integrally formed by forging process, and a right angle can be formed by the swing center 2113 and the transmission portion 2124.

Figure 9:
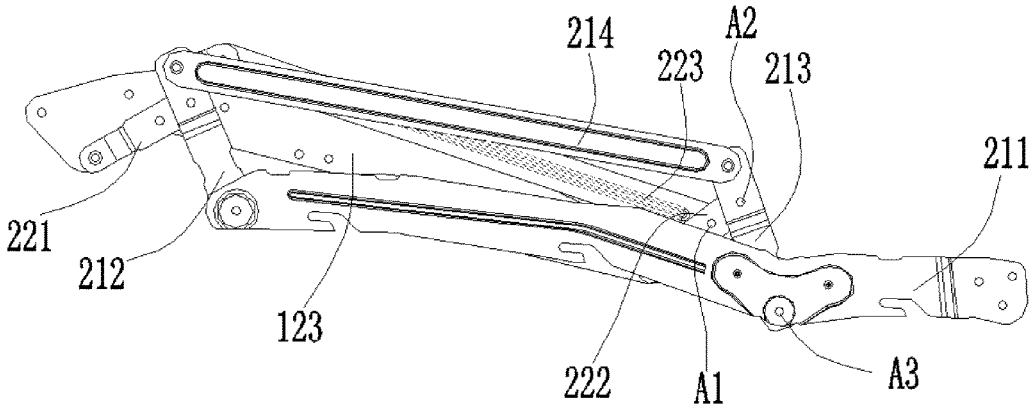
FIG. 9 is a partial structural schematic view of the transmission mechanism of the movable chair device at another visual angle of FIG. 8.

Referring to FIG. 2 and FIG. 9, furthermore, in the present disclosure, a pivot point A1 between the second transmission arm 222 and the third transmission arm 223 is located between a pivot point A2 of the second transmission arm 222 and the second swing arm 213 and a pivot point A3 of the second transmission arm 222 and the chair mechanism 10. A pivot point A2 between the second swing arm 213 and the second transmission arm 222 is located between a pivot point B2 of the second swing arm 213 and the first linkage member 214 and a pivot point B3 of the second swing arm 213 and the fixing member 211.

Figure 8:
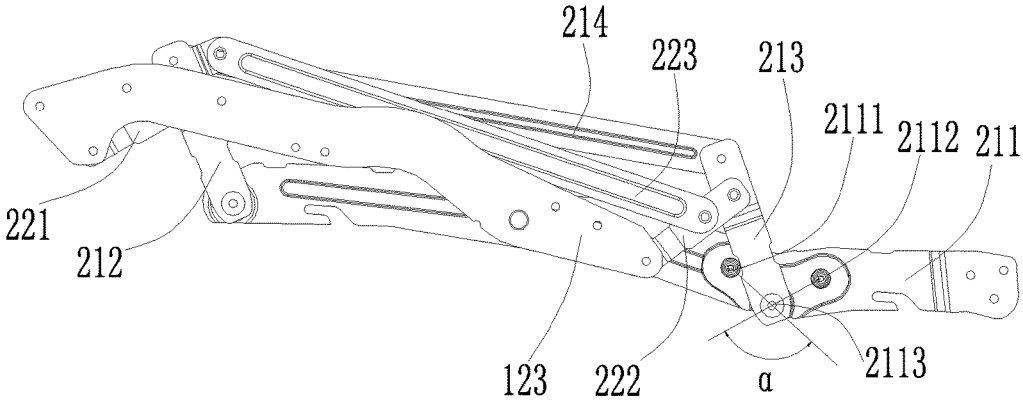
FIG. 8 is a partial structural schematic view of the transmission mechanism of the movable chair device in a first limiting state of FIG. 1.
Figure 10:
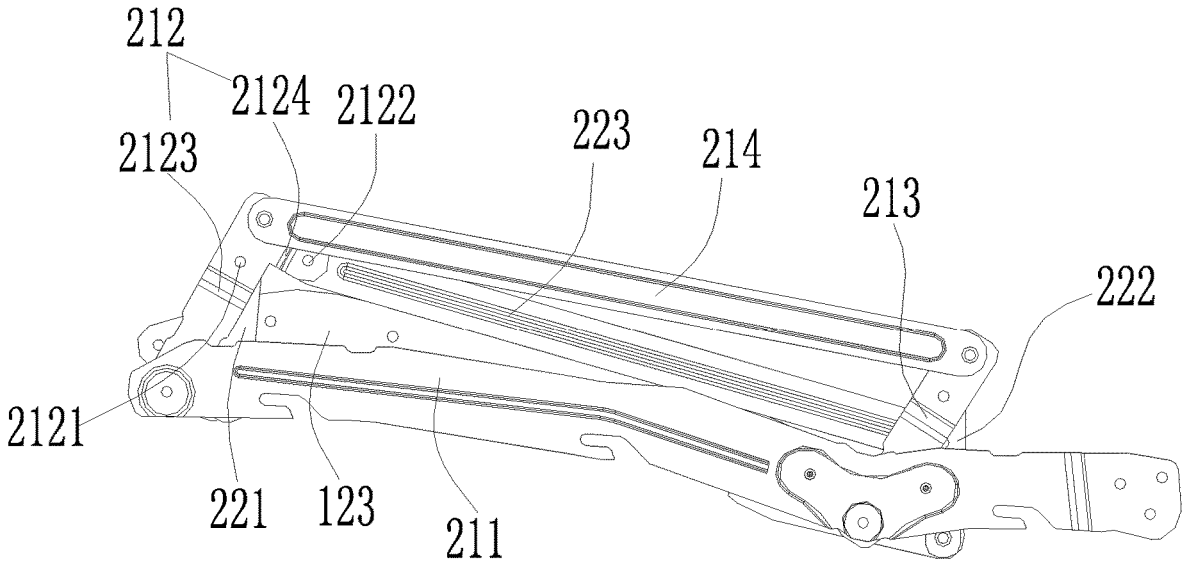
FIG. 10 is a partial structural schematic view of the transmission mechanism in a second limiting state of FIG. 8.

Referring to FIGS. 8 to 10, FIG. 8 is a partial structural schematic view of the transmission mechanism 20 of the movable chair device 100 in a first limiting state of FIG. 1. FIG. 9 is a partial structural schematic view of the transmission mechanism 20 of the movable chair device 100 at another visual angle of FIG. 8. FIG. 10 is a partial structural schematic view of the transmission mechanism 20 in a second limiting state of FIG. 8.

In some embodiments, a stopping convex block 112 can be fixedly arranged on the chair component 11 for stopping the third swing arm 121 and/or the fourth swing arm 122, and limiting a range of a motion of the secondary transmission component 12 relative to the chair component 11. Specifically, when the state of use of the movable chair device 100 switches from sitting or leisure to lying, the stopping convex block 112 is able to limit the motion of the secondary transmission component 12 relative to the chair component 11 by stopping the third swing arm 121 and/or the fourth swing arm 122. At this moment, the chair component 11 can remain stationary relative to the fixing member 211, thus sustaining weight of the user more stably.

In this way, when the state of use of the movable chair device 100 is lying, the stopping convex block 112 is able to restrict a movement of the secondary transmission component 12 relative to the chair component 11, so that the movable chair device 100 provides better structural stability and support stability in the state of lying, and the secondary transmission component 12 would not deform due to external forces, ensuring a better supporting stability of the movable chair device 100.

In the present embodiment, a group of the stopping convex blocks 112 is fixedly arranged on the chair component 11 for stopping the fourth swing arm 122.

In some embodiments, the fixing member 211 is provided with a first limiting portion 2111, a second limiting portion 2112, and a swing center 2113. The swing center is defined as a pivot point between the fixing member 211 and the second swing arm 213. The first limiting portion 2111 is located at a side near the front end of the chair component 11 of the swing center 2113, and the second limiting portion 2112 is located at a side near the rear end of the chair component 11 of the swing center 2113. A swing angle $\alpha$ is defined by a line between the first limiting portion 2111 and the swing center 2113 and a line between the second limiting portion 2112 and the swing center 2113; and the first limiting portion 2111 and the second limiting portion 2112 are configured for abutting against a side of the second swing arm 213, respectively, resulting in that the second swing arm 213 is able to swing relative to the fixing member 211 within a range of the swing angle $\alpha$.

In this way, when the state of use of the movable chair device 100 is sitting, the first limiting portion 2111 is able to restrict a further movement of the primary transmission component 21 relative to the chair mechanism 10, and when the state of use of the movable chair device 100 is leisure, the second limiting portion 2112 is able to restrict a further movement of the primary transmission component 21 relative to the chair mechanism 10. The first limiting portion 2111 can ensure that the movable chair device 100 maintains better structural stability in the state of leisure and restricts the movement of the primary transmission component 21 when the state of use of the movable chair device 100 switches from leisure to lying, thus avoiding a synchronous motion of the primary transmission component 21 and the secondary transmission component 12. The second limiting portion 2112 can ensure that the movable chair device 100 maintains better structural stability in the state of sitting, thus avoiding accidental movement of the chair mechanism 10.

The present disclosure further provides a chair assembly including the support 30 and the movable chair device 100 as described above, and the support 30 is capable of being placed on the ground and is fixedly connected to the fixing member 211.

The movable chair device 100 provides better smoothness, better reliability of load-bearing, and higher load-bearing limit in motion. Thus, the movable chair device 100 can alleviate the wear and tear and jamming in operation, improve response sensitivity to the power input of the driving mechanism 60, and is less prone to non-action or movement suspension, thus providing a much better user experience.

The following is an explanation of a motion process of the movable chair device 100 in this embodiment, in which a complete movement of the movable chair device 100 is divided into two different stages.

In a first stage: as shown in FIG. 5, when the movable chair device 100 is in a sitting state, the length of the screw extending from the motor body is shortest, while the second limiting portion 2112 can abut against the second swing arm 213. At this time, if the user sits on the chair supporting area 111, the user's back stays straight while legs drops down. Then, when the driving mechanism 60 is in operation, the length of the screw extending from the motor body can increase, and the end of the screw extending from the motor body applies an urging force to the footrest mechanism 40. At this time, an end away from the chair component 11 of the footrest mechanism 40 can extend towards the outside of the front side of the chair component 11, and also drive the secondary transmission component 12 to move relative to the fixing member 211, resulting in the movement of the closed-loop four-link mechanism formed by the third swing arm 121, the chair component 11, the fourth swing arm 122, and the second linkage member 123, which can drive the chair component 11 to move forward of the user, thus switching the state of use of the movable chair device 100 from sitting to leisure. As shown in FIG. 5, when the movable chair device 100 is in a leisure state, the stopping convex block 112 is able to abut against the second swing arm 213 and limit a motion of the secondary transmission component 12 relative to the chair component 11. During the switch from the sitting state to the leisure state of the movable chair device 100, the primary transmission component 21 can remain motionless or almost motionless, and the intermediate transmission component 22 has a slight movement.

In a second stage: the driving mechanism 60 can continue to operate and outputs driving thrust, and the footrest mechanism 40 can transmit the power of the driving mechanism 60 to the intermediate transmission component 22 by the secondary transmission component 12 to drive the primary transmission component 21 to move. During the switch from the leisure state to the lying state of the movable chair device 100, firstly, the angle between the back mechanism 50 and the chair component 11 can increase, and the back mechanism 50 can move towards outside of the rear end of the chair component 11 to support the user's back and lumbar in lying state. The first transmission arm 221, the second transmission arm 222 and the third transmission arm 223 can apply tractive force to the first swing arm 212 and the second swing arm 213, resulting in deforming of the closed-loop four-link mechanism formed by the fixing member 211, the first swing arm 212, the second swing arm 213, and the first linkage member 214, which can drive the first linkage member 214 to move towards the front of chair component 11. The fixing member 211 can be regarded to be fixed relative to the ground due to a connection between the fixing member 211 and the support 30, thus driving the chair component 11 further to move forward of the user relative to the fixing member 211. When the movable chair device 100 is in a lying state, the first limiting portion 2111 is able to stop the second swing arm 213 from rotating relative to the fixing member 211, limiting a further deformation of the primary transmission component 21, and the state of the movable chair device 100 is shown in FIG. 7. During the switch from the leisure state to the lying state, there is almost no relative motion between the chair component 11 and the secondary transmission component 12, and main deformation is generated by the primary transmission component 21.

During the switch from the sitting state to the leisure state, and the leisure state to the lying state of the movable chair device 100, the chair component 11 can move in the direction parallel to the chair supporting area 111 relative to the fixing member 211, and there is a slight change in a height direction in the whole process of movement, which is not easy to cause an obvious up and down feeling.

When the movable chair device 100 is in a sitting state, the second limiting portion 2112 can sustain a part of the weight of the user and the chair component 11 by stopping the second swing arm 213. When the movable chair device 100 is in a lying state, the first limiting portion 2111 can sustain a part of the weight of the user and the chair component 11 by stopping the second swing arm 213, and the stopping convex block 112 can sustain a part of the weight of the user and the chair component 11 by stopping the fourth swing arm 122, respectively.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

We claim:

1. A movable chair device, comprising a chair mechanism and a transmission mechanism, wherein the transmission mechanism comprises a primary transmission component and an intermediate transmission component;

the primary transmission component comprises:

a fixing member configured for fixing to a support;

a first swing arm pivotally connected to the fixing member;

a second swing arm pivotally connected to the fixing member; and a first linkage member pivotally connected to the first swing arm and the second swing arm respectively, wherein the first linkage member is enclosed with the first swing arm, the second swing arm and the fixing member to form a closed-loop connecting rod mechanism; and the intermediate transmission component comprises:

a first transmission arm, a first end of which is pivotally connected to the first swing arm and a second end of which is pivotally connected to the chair mechanism;

a second transmission arm, a first end of which is pivotally connected to the second swing arm and a second end of which is pivotally connected to the chair mechanism; and a third transmission arm, a first end of which is pivotally connected to the second transmission arm, and a second end of which is movably connected to the first transmission arm and/or the first swing arm; and a first pin joint and a second pin joint are disposed between two ends of the first swing arm, the first pin joint is configured for being pivotally connected to the first transmission arm, and the second pin joint is configured for being pivotally connected to the third transmission arm.

2. The movable chair device of claim 1, wherein the first swing arm comprises a swing portion and a transmission portion protruding from a side of the swing portion, a first end of the swing portion is pivotally connected to the first linkage member, a second end of the swing portion is pivotally connected to the fixing member, and an angle is defined between the transmission portion and the swing portion; and the first pin joint is located at the swing portion, and the second pin joint is located at a side away from the swing portion of the transmission portion.

3. The movable chair device of claim 1, wherein a pivot point between the second transmission arm and the third transmission arm is located between a pivot point of the second transmission arm and the second swing arm and a pivot point of the second transmission arm and the chair mechanism.

4. The movable chair device of claim 1, wherein a pivot point between the second swing arm and the second transmission arm is located between a pivot point of the second swing arm and the first linkage member and a pivot point of the second swing arm and the fixing member.

5. The movable chair device of claim 1, wherein the chair mechanism comprises a chair component and a secondary transmission component, the chair component is provided with a chair supporting area for supporting body, and the secondary transmission component is connected to a side away from the chair supporting area of the chair component.

6. The movable chair device of claim 5, wherein the secondary transmission component comprises:

a third swing arm, an end of which is pivotally connected to a side away from the chair supporting area of the chair component;

a fourth swing arm, an end of which is pivotally connected to a side away from the chair supporting area of the chair component; and a second linkage member, wherein a first pivot point, a second pivot point, a third pivot point, and a fourth pivot point are disposed on the second linkage member sequentially along a length direction of the second linkage member; and the first pivot point is pivotally connected to the third swing arm, the second pivot point is pivotally connected to the first transmission arm, the third pivot point is pivotally connected to the fourth swing arm, and the fourth pivot is pivotally connected to the second transmission arm.

7. The movable chair device of claim 6, wherein a stopping convex block is fixedly arranged on the chair component for stopping the third swing arm and/or the fourth swing arm, and limiting a range of a motion of the secondary transmission component relative to the chair component.

8. The movable chair device of claim 1, wherein the fixing member is provided with a first limiting portion, a second limiting portion, and a swing center, which is defined as a pivot point between the fixing member and the second swing arm;

a swing angle is defined by a line between the first limiting portion and the swing center and a line between the second limiting portion and the swing center; and the first limiting portion and the second limiting portion are configured for abutting against the second swing arm, respectively, resulting in that the second swing arm is able to swing relative to the fixing member within a range of the swing angle.

9. A chair assembly, comprising a support, and a movable chair device, wherein the movable chair device comprises a chair mechanism and a transmission mechanism, and the transmission mechanism comprises a primary transmission component and an intermediate transmission component;

the primary transmission component comprises:

a fixing member configured for fixing to the support;

a first swing arm pivotally connected to the fixing member;

a second swing arm pivotally connected to the fixing member; and a first linkage member pivotally connected to the first swing arm and the second swing arm respectively, wherein the first linkage member is enclosed with the first swing arm, the second swing arm and the fixing member to form a closed-loop connecting rod mechanism; and the intermediate transmission component comprises:

a first transmission arm, a first end of which is pivotally connected to the first swing arm and a second end of which is pivotally connected to the chair mechanism;

a second transmission arm, a first end of which is pivotally connected to the second swing arm and a second end of which is pivotally connected to the chair mechanism; and a third transmission arm, a first end of which is pivotally connected to the second transmission arm, and a second end of which is movably connected to the first transmission arm and/or the first swing arm;

the support is capable of being placed on the ground and is fixedly connected to the fixing member; and a first pin joint and a second pin joint are disposed between two ends of the first swing arm, the first pin joint is configured for being pivotally connected to the first transmission arm, and the second pin joint is configured for being pivotally connected to the third transmission arm.

10. The chair assembly of claim 9, wherein the first swing arm comprises a swing portion and a transmission portion protruding from a side of the swing portion, a first end of the swing portion is pivotally connected to the first linkage member, a second end of the swing portion is pivotally connected to the fixing member, and an angle is defined between the transmission portion and the swing portion; and the first pin joint is located at the swing portion, and the second pin joint is located at a side away from the swing portion of the transmission portion.

11. The chair assembly of claim 9, wherein a pivot point between the second transmission arm and the third transmission arm is located between a pivot point of the second transmission arm and the second swing arm and a pivot point of the second transmission arm and the chair mechanism.

12. The chair assembly of claim 9, wherein a pivot point between the second transmission arm and the third transmission arm is located between a pivot point of the second transmission arm and the second swing arm and a pivot point of the second transmission arm and the chair mechanism.

13. The chair assembly of claim 9, wherein the chair mechanism comprises a chair component and a secondary transmission component, the chair component is provided with a chair supporting area for supporting body, and the secondary transmission component is connected to a side away from the chair supporting area of the chair component.

14. The chair assembly of claim 13, wherein the secondary transmission component comprises:

a third swing arm, an end of which is pivotally connected to a side away from the chair supporting area of the chair component;

a fourth swing arm, an end of which is pivotally connected to a side away from the chair supporting area of the chair component; and a second linkage member, wherein a first pivot point, a second pivot point, a third pivot point, and a fourth pivot point are disposed on the second linkage member sequentially along a length direction of the second linkage member; and the first pivot point is pivotally connected to the third swing arm, the second pivot point is pivotally connected to the first transmission arm, the third pivot point is pivotally connected to the fourth swing arm, and the fourth pivot is pivotally connected to the second transmission arm.

15. The chair assembly of claim 14, wherein a stopping convex block is fixedly arranged on the chair component for stopping the third swing arm and/or the fourth swing arm, and limiting a range of a motion of the secondary transmission component relative to the chair component.

16. The chair assembly of claim 9, wherein the fixing member is provided with a first limiting portion, a second limiting portion, and a swing center, which is defined as a pivot point between the fixing member and the second swing arm;

a swing angle is defined by a line between the first limiting portion and the swing center and a line between the second limiting portion and the swing center; and the first limiting portion and the second limiting portion are configured for abutting against the second swing arm, respectively, resulting in that the second swing arm is able to swing relative to the fixing member within a range of the swing angle.

* * * * *